US007955282B2

(12) United States Patent
Doo

(10) Patent No.: US 7,955,282 B2
(45) Date of Patent: Jun. 7, 2011

(54) SYSTEM AND DEVICE TO SCULPT AN INDIVIDUAL'S BODY

(76) Inventor: Hong-Jik Doo, Seoul (KR)

( * ) Notice: Subject to any disclaimer, the term of this patent is extended or adjusted under 35 U.S.C. 154(b) by 1264 days.

(21) Appl. No.: 11/522,952

(22) Filed: Sep. 19, 2006

(65) Prior Publication Data

US 2008/0071197 A1 Mar. 20, 2008

(51) Int. Cl.
*A61H 1/00* (2006.01)

(52) U.S. Cl. ..... 601/2; 601/15; 601/46

(58) Field of Classification Search ..... 601/2, 15, 601/20, 21, 46, 48, 49, 70, 71, 79, 143; 607/2, 607/3, 72, 48, 149, 152, 154
See application file for complete search history.

(56) References Cited

U.S. PATENT DOCUMENTS 5,762,616 A * 6/1998 Talish ..... 601/2
2004/0044298 A1* 3/2004 Kawabata et al. ..... 601/2
2005/0043655 A1* 2/2005 Schenck ..... 601/15
* cited by examiner

*Primary Examiner* — Quang D Thanh
(74) *Attorney, Agent, or Firm* — Stanzione & Kim, LLP

(57) ABSTRACT

A system and device to sculpt an individual's body. The system and device are capable of selectively burning adipose tissue located in a user's abdomen, waist, thigh, arms, etc., and of generating vibration to produce heat from friction such that blood circulation can be enhanced. The device to sculpt the body includes a body sculpture holder, attached to the user's body, to generate an ultrasonic frequency, an intermediate frequency, and a low frequency, a portable body electrically connected to the sculpture holder, and a fixed body on to which the portable body is fixed.

16 Claims, 8 Drawing Sheets

SYSTEM AND DEVICE TO SCULPT AN INDIVIDUAL'S BODY

BACKGROUND OF THE INVENTION

1. Field of the Invention

The present general inventive concept relates to a body sculpting apparatus and a system including the body sculpting apparatus, and more particularly, to a sculpting device to sculpt an individual's body by selectively burning fat stored in a user's body and to generate a vibration to produce heat from friction such that blood circulation can be enhanced, and a system including the sculpting device.

2. Description of the Related Art

Generally, obesity is a condition in which excessive adipose tissue has accumulated on a body and usually concerns persons having a body fat 20 percent above a recommended body fat percentage with regard to a weight for a predetermined height and age. For example, a man is obese when his body fat percentage is 20% above a predetermined maximum weight. A woman is obese when her body fat percentage is 30% above her weight. Obesity can be variously classified based on causes of the obesity. Adipose tissue is mainly accumulated in a person's abdomen, waist, thighs, and arms.

In order to burn the fat in the body, a conventional apparatus to burn fat includes a low frequency generator having a pad and a belt in which the low frequency generator is installed while a user wears the belt on a body portion. The low frequency generator is controlled by an external controller.

Although the conventional low frequency generator can burn the fat in the user's body, the conventional pad of the low frequency generator has disadvantages in that, since the pad must be inserted to an additionally manufactured belt, which is closely attached to a corresponding part of the user's body, the pad can be relocated to other parts of the user's body from the corresponding part, or escaped therefrom, even by slight movements by the user.

Also, since most of the external controllers which control the low frequency generators are relatively large in size, they must be fixedly installed at a specific placement. Therefore the conventional low frequency generator cannot be easily used by users at any non-specific placement, such as the user's home.

SUMMARY OF THE INVENTION

The present general inventive concept provides a system and device to sculpt an individual's body, capable of selectively burning fat stored in a user's abdomen, waist, thigh, arms, etc., and to generate vibrations to produce heat from a friction such that a blood circulation can be enhanced.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a system to sculpt a body, including a body sculpture belt to selectively massage portions of a body, a portable body electrically connected to the body sculpture belt to provide power thereto, and a fixed body electrically connected to the portable body.

The foregoing and/or other aspects and utilities of the present general inventive concept may also be achieved by providing a device to sculpt a body, including a body sculpture belt to vibrate a specific body portion at an ultrasonic frequency, a middle frequency, and a low frequency to burn an adipose tissue of the specific body portion and to enhance the blood circulation of the body, a portable body to control the body sculpture belt, and a fixed body to which the portable body is safely fixed, with a predetermined height to allow access the portable body.

The device may include an ornamental plate formed on the front of the cover to make the appearance of a portable body beautiful, and a display apparatus is formed in the middle portion of the ornamental plate to display present operation states.

The portable body may be fixedly and stably maintained at a predetermined height to allow access to the portable body, wires thereof maybe installed towards the ground so that they can be in a stable state, and devices for a body sculpture may be received and kept thereby.

The foregoing and/or other aspects and utilities of the present general inventive concept may also be achieved by providing a system for an individual body sculpture including a device to sculpt a body including a body sculpture belt, a portable body, and a fixed body, which are electrically connected to each other, wherein the device selectively manages some portions of a user's body.

The foregoing and/or other aspects and utilities of the present general inventive concept may also be achieved by providing a device to sculpt a body, including portable body formed as a carrying case to control one or more external bodies, the portable body having a control unit to select an operational state of the device, a controller to generate control signals to control a low and/or middle frequencies and ultrasonic frequencies according to the operational state, a display unit to display an image according to the operation state, and terminals to output the control signals to the one or more external bodies.

The foregoing and/or other aspects and utilities of the present general inventive concept may be achieved by providing a device to sculpt a body, including a body sculpture belt to vibrate a specific body part of the body, having at least one low and/or middle frequency generator to generate a vibration with low and/or middle frequency, at least one ultrasonic frequency generator to generate a vibration with an ultrasonic frequency, and a power and/or signal cable to supply a power signal to the at least one middle and/or low frequency generator and the at least one ultrasonic frequency generator.

The foregoing and/or other aspects and utilities of the present general inventive concept may also be achieved by providing a device to sculpt a body including a body sculpture belt to vibrate a specific body portion of the user with an ultrasonic, middle, and low frequencies, etc. to burn the fat of the specific body portion and to enhance the blood circulation of the user's body, in which the body sculpture belt is put on the specific portion of the user, a portable body to control the body sculpture belt electrically connected thereto, in which the portable body is shaped as a briefcase, so that the user can easily carry the portable body, and a fixed body to which the portable body is safely fixed, with a predetermined height such that the user can easily control the portable body.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
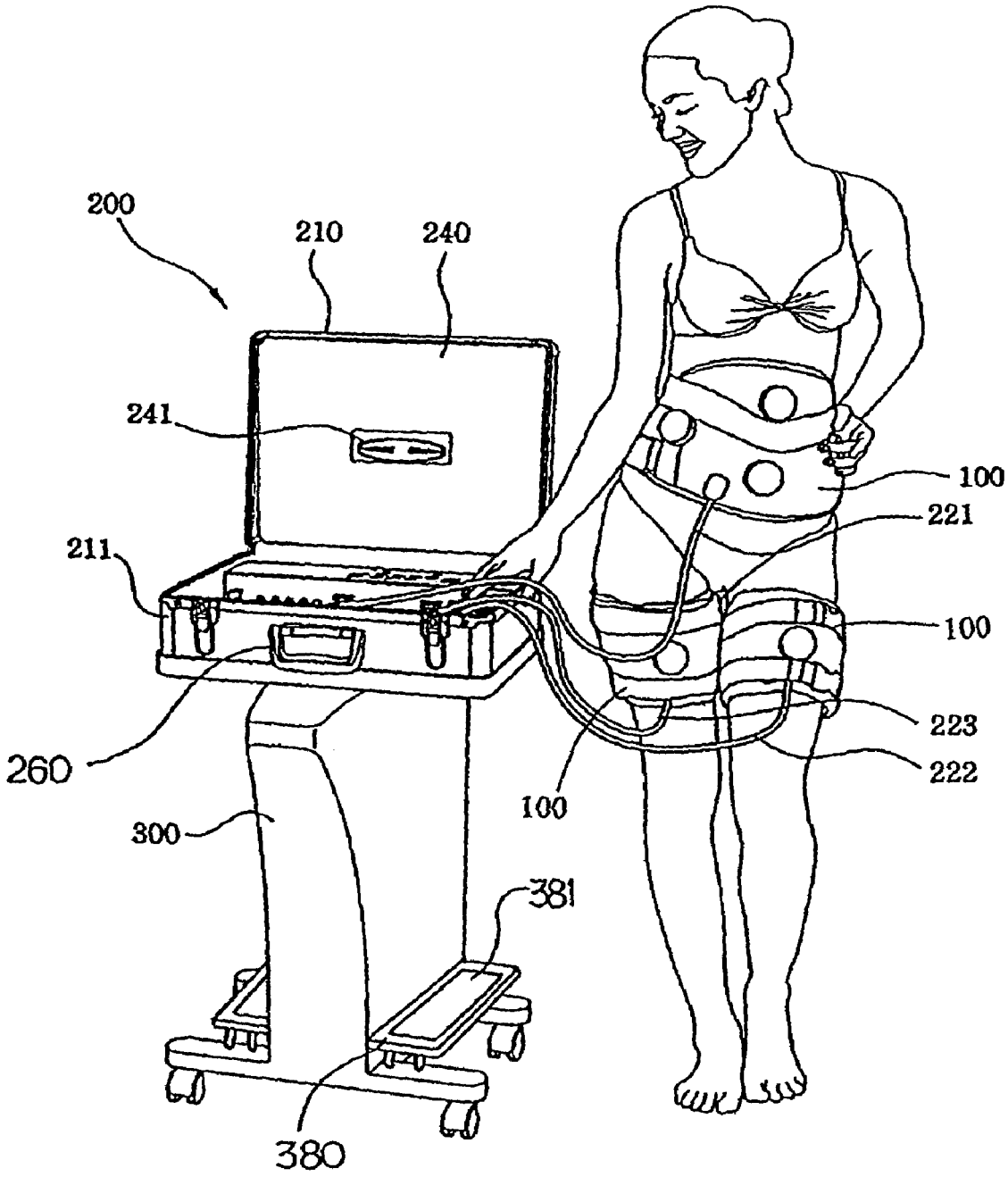
FIG. 1 is a perspective view illustrating a system and a device to sculpt an individual's body according to the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a perspective view illustrating a system and a device to sculpt an individual's body according to an embodiment of the present general inventive. Referring to FIG. 1, the system and the device to sculpt a body includes a body sculpture belt 100, a portable body 200, and a fixed body 300, which are electrically connected to each other. A user may use the body sculpture belt 100 such that the body sculpture belt 100 can be selectively applied to a specific body portion of the user's body. FIG. 1 illustrates an example of a user that applied three body sculpture belts 100 to the body.

The body sculpture belt 100 vibrates the specific body portion of the user with ultrasonic, middle, and low frequencies, etc., to burn fat at the specific body portion and to enhance a blood circulation of the user's body. The body sculpture belt 100 is put on the specific body portion of the user. The portable body 200 controls the body sculpture belt 100, which is electrically connected thereto. The portable body 200 may be shaped as a briefcase, so that the user can easily carry the portable body 200. The portable body 200 can be safely fixed to the body 300. The fixed body 300 may have a predetermined height so that the user can easily access and control the portable body 200. The portable body 200 may include a control box 211, a case cover 210, and a handgrip 260. An ornamental plate 240 may include a display window 241 to display an image. The image may be an operation state of the portable body 200 and/or the body sculpture belt 100. The body sculpture belt 100, the portable body 200, and the fixed body 300 will be described in detail with reference to FIGS. 3-11 hereinafter.

Figure 3:
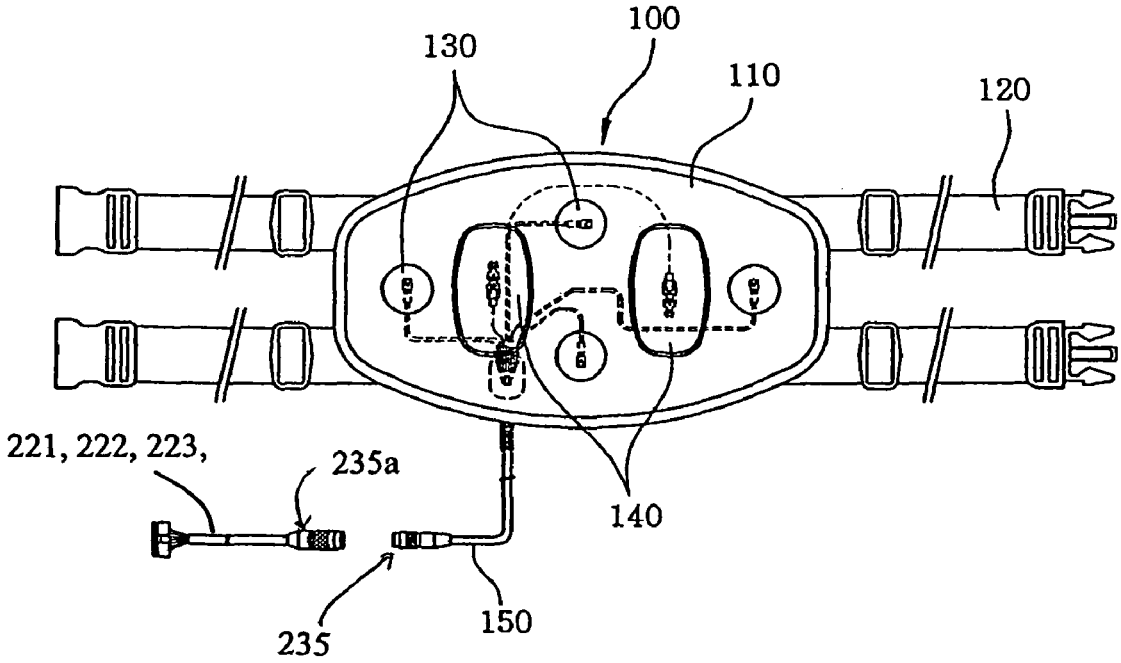
FIG. 3 is a top view illustrating a body sculpture belt of the system of FIG. 1.

FIG. 3 is a top view illustrating the body sculpture belt 100 of FIG. 1. Referring to FIGS. 1 and 3, the body sculpture belt 100 includes a body 110, a belt 120, a plurality of ultrasonic frequency generators 130, at least one middle and/or low frequency generators 140 aligned to an inside of the body sculpture belt 100, and a power and/or signal cable 150 to connect the generators 130 and 140 to a power and/or signal source, such as the portable body 200. The power and/or signal cable 150 has a connector 235 provided at end thereof to detachably connect to any of connection lines 221, 222, and 223 via a connector 235*a*.

Figure 4:
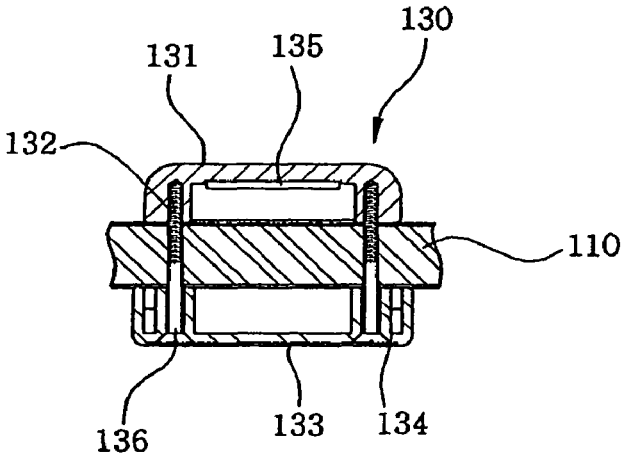
FIG. 4 is a cross-sectional view of an ultrasonic wave generator of FIG. 3.

FIG. 4 is a cross-sectional view illustrating the ultrasonic wave generator 130 of FIG. 3. Referring to FIGS. 3 and 4, the ultrasonic frequency generator 130 includes a vibrator 135 to apply the ultrasonic vibration to the user's body, a vibrator head 131 which is in direct contact with the user's body, and a binding unit 133 and a coupling member 136 which connects the vibrator head 131 to the body 110 of the body sculpture belt 100.

Here, the vibrator head 131 is located at an inside of the body 110. A vibrator 135 is attached to an upper portion of the vibrator head 13 to face the body 110, so that the vibrator 135 is operated using electricity. A plurality of coupling holes 132 are formed around an edge of a lower portion of the vibrator head 131 to receive the coupling member 136.

The binding unit 133 has a plurality of coupling holes 134 at an edge thereof to correspond to positions of the coupling holes 132 of the vibrator head 131. The coupling holes 134 are located on a side of the body sculpture belt 100 opposite the vibrator head 131. That is, the binding unit 133 and the coupling holes 134 are located on an outside portion of the body 110 when the body 110 is applied to the user.

The coupling member 136 may couple the vibrator head 131 and the binding unit 133 in a screw coupling fashion when the positions of the coupling holes 132 of the vibrator head 131 are coincident with those of the coupling holes 134 of the binding unit 133. That is, the binding unit 133 and the vibrator head 131 are joined together by the coupling member on opposite sides of the body 110. The vibrator head 131 is fixedly coupled to a side of the body 110 that is opposite the binding unit 133. When the body 110 is wrapped around the user, the vibrator head 131 is located on the inside portion exposed to the user's body with respect to the body 110, respectively and the binding unit 133 is on the outside portion of the body 110. Therefore, the coupling member 136 can allow a user to easily assemble and disassemble the ultrasonic frequency generator 130 to provide after-sales services to the ultrasonic frequency generator 130.

One or more ultrasonic frequency generators 130 may be installed to the body 110, such that the ultrasonic frequency generators 130 can be utilized together with the middle and/or low frequency generator 140.

Figure 5:
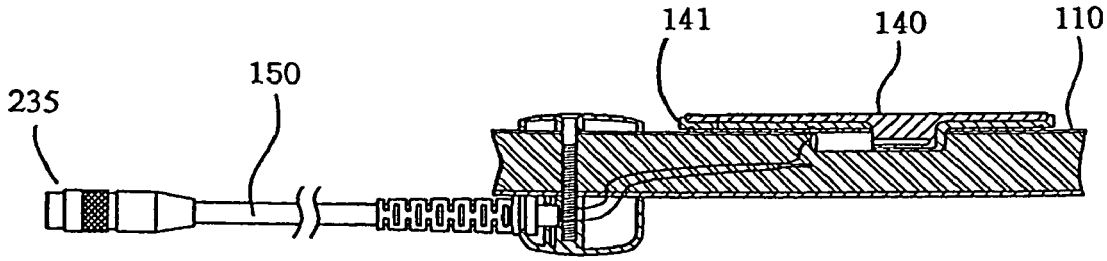
FIG. 5 is a cross-sectional view illustrating a low/intermediate frequency generator of FIG. 3.
Figure 6:
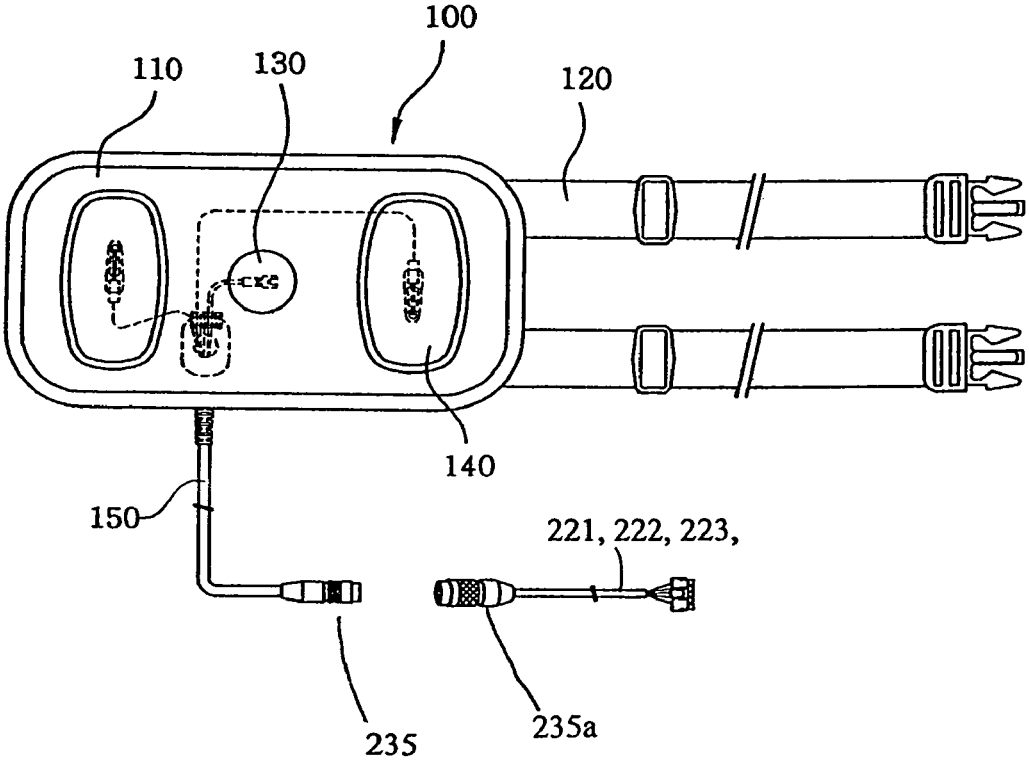
FIG. 6 is a top view illustrating a body sculpture belt of the system of FIG. 1.

FIG. 5 is a cross-sectional view illustrating a middle and/or low frequency generator 140 according to an embodiment of the present general inventive concept. Referring to FIG. 5, each of the ultrasonic frequency generators 130 and the middle and/or low frequency generators 140 use the power and/or signal cable 150 to receive the power signal or signal. The power and/or signal cable 150 has the connection unit 235 that may include male or female structures. FIG. 6 is a top view illustrating the body sculpture belt 100 of the system of FIG. 1. Referring to FIG. 6, the body sculpture belt 110 has one ultrasonic frequency generator 130 and two middle and/or low frequency generators 140, although FIG. 3 illustrates an embodiment of the present general inventive concept having four ultrasonic frequency generators 130 and two middle and/or low frequency generators 140.

Referring to FIGS. 1 and 3, the body sculpture belt 100 is put on the user's abdomen and may be configured such that the ultrasonic frequency generators 130 are installed between the middle and/or low frequency generators 140 to widely apply the ultrasonic frequency vibration to a portion of the user's abdomen. Referring to FIGS. 3 and 6, the body sculpture belt 100 intended for the user's thigh or arms, etc., may be configured such that one or two ultrasonic frequency generators 130 are installed to a middle portion of the body 110 between the middle and/or low frequency generators 140.

The number of the ultrasonic frequency generators 130 illustrated in FIG. 3 may be increased as the number of the middle and/or low frequency generators 140 is harmonized with the number of the ultrasonic frequency generators 130.

In a case that the one or more ultrasonic frequency generators 130 are continuously used, the user's body may be harmed or the vibrator 135 may break down due to an overheating thereof. Therefore, the one or more ultrasonic frequency generators 130 may be alternately or periodically operated. Accordingly, the one or more ultrasonic frequency generators 130 are set such that they are simultaneously and alternately operated in an up and down, left and right direction, or sequentially operated from left to right, and are periodically turned on and off according to a predetermined time previously set through an ultrasonic frequency controller.

The middle and/or low frequency generator 140 includes a pad (not pictured) which may be attached to the body sculpture belt 100 by silicon 141 coated between the body 110 and the middle and/or low frequency generator 140. The middle and/or low frequency generators 140 are provided on both left and right sides of the body 110, having a predetermined distance from a center of the body 110, respectively.

Referring back to FIG. 5, a number of the middle and/or low frequency generators 140 may be such that the middle and/or low frequency generators 140 cannot be intensively operated in only the specific body portion of the user's body. Therefore, an even number of the middle and/or low frequency generators 140 can equally treat the user's body, such as a left and right side. Also, the middle and/or low frequency generator 140 may be configured such that the middle and/or low frequency generators 140 can be electrically controlled by a middle and/or low frequency controller.

Figure 7:
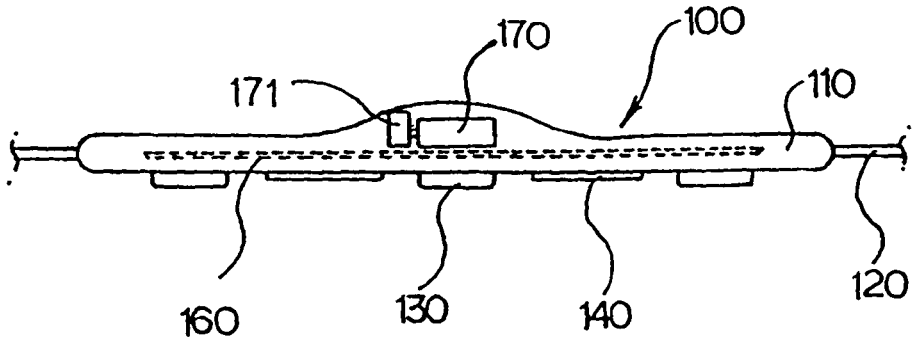
FIG. 7 is a side view illustrating a body sculpture belt of the system of FIG. 1.

FIG. 7 is a side view illustrating the body sculpture belt 100 of the system of FIG. 1. Referring to FIG. 7, the body sculpture belt 100 may also include a surface heat emitting body 160 on a rear side. Therefore, heat generated from the surface heat emitting body 160 can effectively burn fat in the user's body and enhance the blood circulation of the user. The body sculpture belt 100 may also include an electrical motor 170 installed at the outside (the portion opposite the user's body) of the heat emitting body 160. Furthermore, the electrical motor 170 may include an eccentric cam 171 provided on a rotation shaft thereof. The rear side of the body sculpture belt 100 may also include a vibration plate (not pictured) to apply a vibration to the user's body as the eccentric cam 171 is rotated when the electrical motor 170 is operated. The vibration plate can be attached to the eccentric cam to periodically vibrate a surface of the body sculpture belt 100.

Regarding the ultrasonic frequency generators 130, and the middle and/or low frequency generators 140*a* detailed description for their electrical circuits will be omitted because they employ well-known circuits.

Figure 2:
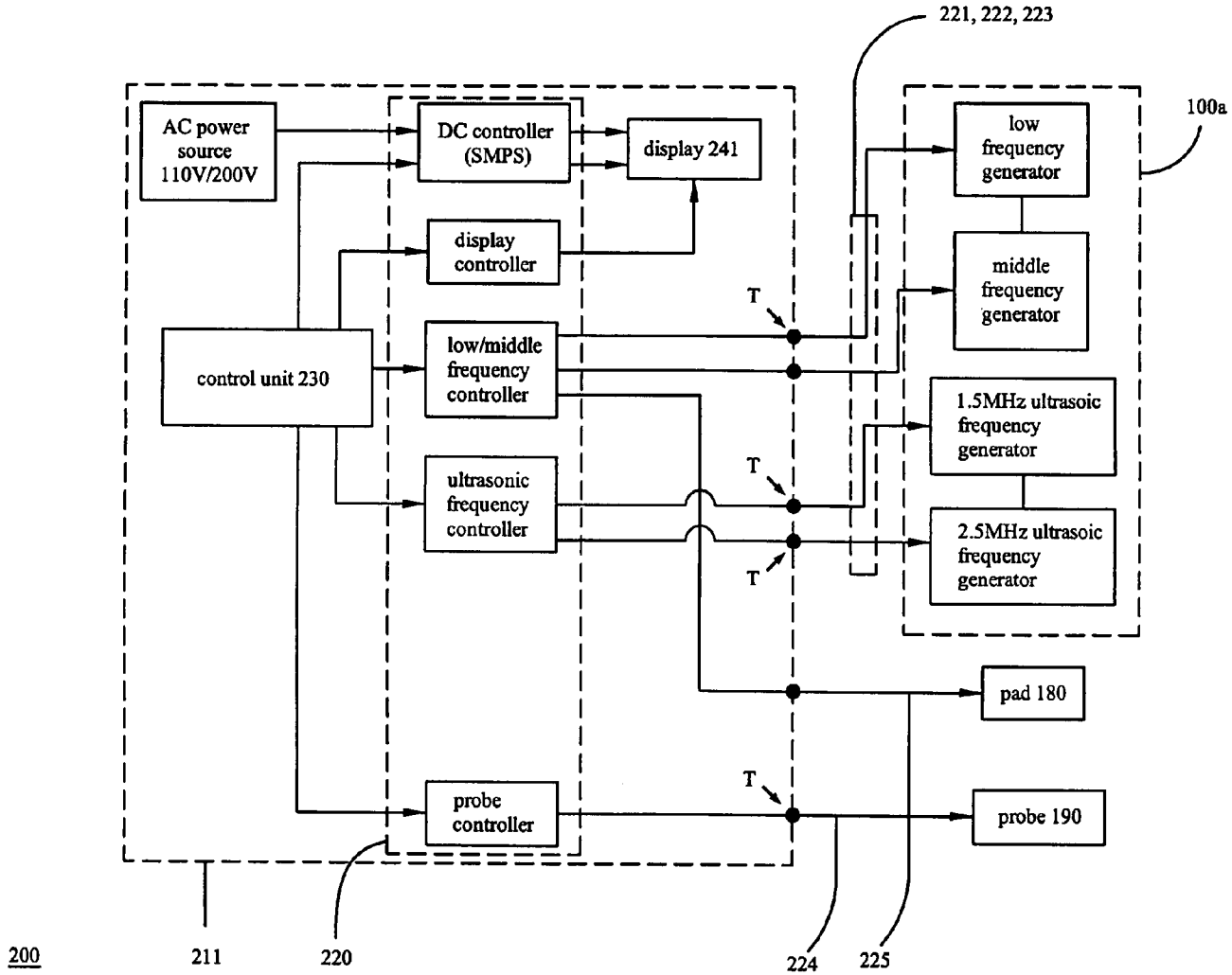
FIG. 2 is a block diagram illustrating a device to sculpt an individual's body according to the present general inventive concept.

FIG. 2 is a block diagram illustrating the portable body 200 to sculpt an individual's body according to an embodiment of the present general inventive concept. Referring to FIG. 2, the sculpting device includes the control box 211, a controller 220, the display window 241, and control unit 230. Attachments to sculpt a user's body may be connected to the control box 211. The attachments may include an exemplary body sculpting belt 100*a*, a probe 190, and a pad 180. The control unit 230 may be formed on an upper portion of the controller 220. The control unit 230 is operated to select an operational state of any of the body sculpting belt 100*a*, the probe 190, and the pad 180. The operational state of the body sculpting belt 100*a*, the probe 190, and the pad 180 may include variables, such as an operational temperature, a time, a vibration strength, etc. That is, the user selects the operational states for attachments that may be connected to the portable body 200 to be used by the user. The controller 220 then controls the attachments according to the selected operational states.

The controller 220 includes a DC Controller (SMPS), a display controller, a middle and/or low frequency controller, an ultrasonic frequency controller, and a probe controller. The DC controller provides DC current to the portable body 200 and the attachments thereto. The DC controller provides a DC current from an AC current input to the portable body 200 from an AC power supply. The display controller controls the display window 241. The probe controller controls the probe 190. Operation states for the attachments to the portable body 200 are selected through the control unit 230. The controller 220 then controls the portable body 200 according to the selected operation states.

The low/middle frequency controller controls the low frequency generator and the middle frequency generator. The low frequency generator and the middle frequency generator may include the middle and/or low frequency generators 130. The ultrasonic frequency controller controls a 1.5 MHz ultrasonic frequency generator and a 2.5 MHz ultrasonic frequency generator. The 1.5 MHz ultrasonic frequency generator and the 2.5 MHz ultrasonic frequency generator may be the one or more ultrasonic frequency generators 140. The body sculpture belt 100*a* is connected to the portable body 200 through terminals T and by connection lines 221, 222, 223. The body sculpture belt 100*a* has low frequency generator, the middle frequency generator, the 1.5 MHz ultrasonic frequency generator, and a 2.5 MHz ultrasonic frequency generator. The pad 180 is controlled by the middle and/or low frequency controller.

Figure 8:
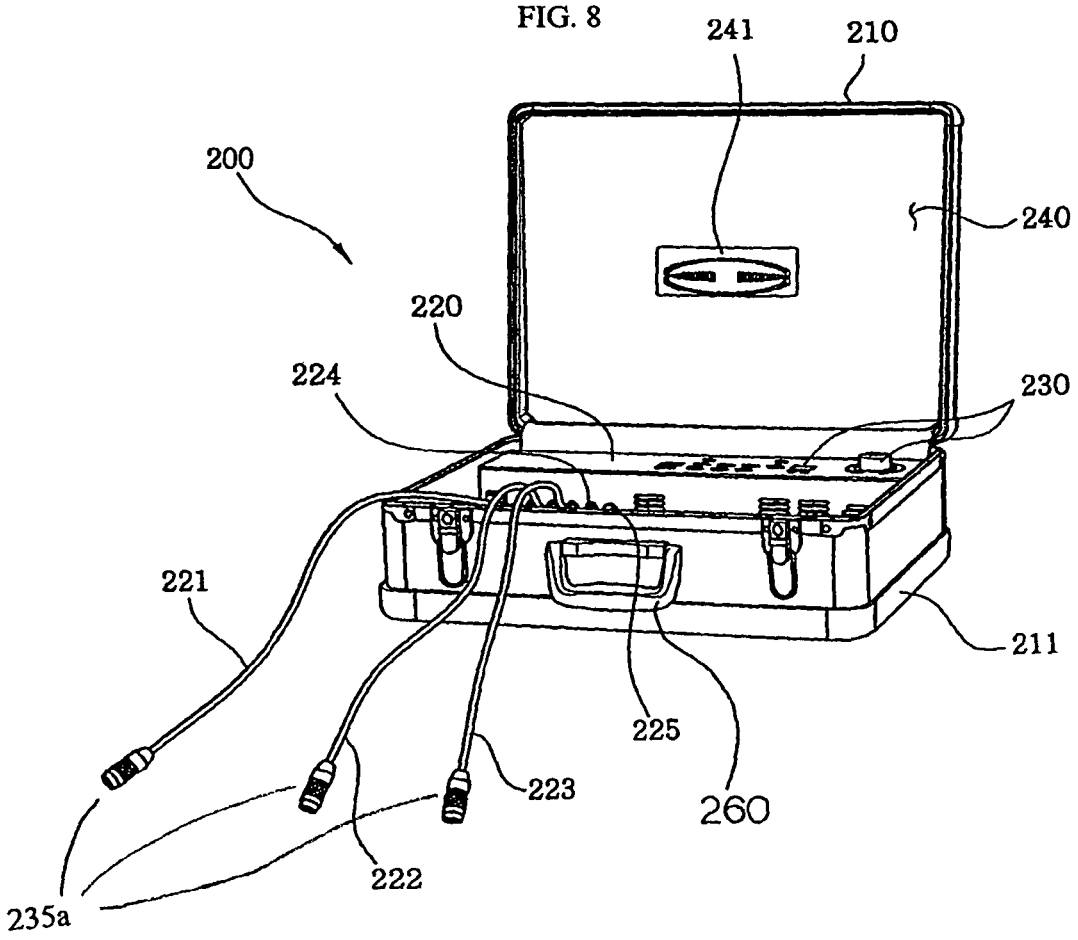
FIG. 8 is a perspective view illustrating a portable body of the system of FIG. 1.

FIG. 8 is a perspective view illustrating the portable body 200 of the system of FIG. 1. Referring to FIGS. 1, 2, and 8, the portable body 200 includes the control box 211, the control unit 230, the ornamental plate 240, the display window 241, and the controller 220. The controller 220 is connected to the AC power supply and the portable body 200 to control the body sculpture belts 100. Each of connection lines 221, 222 and 223 to be connected to the body sculpture belt 100 includes a connection unit 235*a*. The power and/or signal cable 150 and the connection lines 221, 222 and 223 may be electrically connected to or disconnected from the body sculpture belt 100 and the control unit 230 through each power and/or signal cables' 150 respective connection unit 235. Referring to FIG. 6, when the user moves while using the body sculpture belt 100 connected to the portable body 200, the user can walk or move to another place while wearing the body sculpture belt 100 or because the connection lines 221, 222, and 223 can be long enough for the user to move or extended by a certain distance.

The portable body 200 may be configured as a briefcase with the cover 210 and a control box 211. The cover 210 includes the ornamental plate 240 located at an inside thereof. The ornamental plate 240 has patterns or characters printed thereon. The display window 241 is provided at a center portion of the cover 210 to display the present operation states to the user. The display window 241 may include an LED and an LCD. The controller 220 is located at one side of a bottom of the control box 211 of the portable body 200. The grip 260 is attached to an end of the control box 211 to be carried by the user. The control box 211 can be carried when the cover 210 is closed. The cover 210 is hingeably coupled to the control box 211, and vertically orientated when the cover 210 is open.

The assembly of the system and device to sculpt an individual's body according to the present general inventive concept is described hereinafter.

Belts 120 are attached to both a left end and a right end of the body 110, respectively. The ultrasonic frequency generator 130, the middle and/or low frequency generator 140, and the power and/or signal cable 150 are prepared for use.

Referring to FIG. 4, the coupling holes 132 and 134 are aligned with each other, in a state where the vibrator head 131 of the one or more ultrasonic frequency generators 130 are located at the inside (the portion to contact the user's body) of the body 110. The binding unit 133 is located on the outside of the body 110. The coupling member 136 is coupled to coupling holes 132 and 134 in a screw coupling fashion, and the vibrator head 131 and the binding unit 133 are fixedly coupled to the inside and outside of the body 110, respectively.

The one or more ultrasonic frequency generators 130 according to an embodiment of the present general inventive concept employ a coupling structure in which the coupling structure is not inserted in to the body 110 but fixed to the body 110 in an exposed state on the inside portion (i.e., facing the user). Therefore, the one or more ultrasonic frequency generators 130 are easily and simply assembled and disembled when applying the after-sales service thereto.

The middle and/or low frequency generator 140 according to an embodiment of the present general inventive concept is attached to the body sculpture belt body 110 having the silicon 141 coated therebetween. A source of power for the one or more ultrasonic frequency generators 130 and the middle and/or low frequency generator 140 are electrically connected to the power and/or signal cable 150.

In order to use the body sculpture belt 100 according to the present general inventive concept, the portion of the body to be treated, such as the abdomen, legs, arms, etc., are selected. After selecting the body portion and based on the selected portion of the user's body, one or more corresponding body sculpture belts 100 are applied to treat the selected body portion. The body sculpture belt 100 may be wrapped around the user by the belts 120 so that the body 110 is in contact with the user.

For example, as illustrated in FIG. 1, when the abdomen and thighs are simultaneously treated, the one or more ultrasonic frequency generators 130 and the middle and/or low frequency generator 140 of the body sculpture belt 100 are positioned on the abdomen and the thighs, respectively, so that the ultrasonic frequency generator 130 and the middle and/or low frequency generator 140 are located at the inside surface of the body 110 to face the user. After the positioning, the one or more ultrasonic frequency generators 130 and the middle and/or low frequency generator 140 are closely attached to the abdomen and thighs using the belts 120.

After attaching the body sculpture belt 100, the power and/or signal cable 150 is electrically connected to the portable body 200 which is stably coupled to the fixed body 300. When power is applied to portable body 200, the controller 220 controls the one or more ultrasonic frequency generators 130 to generate ultrasonic vibrations that are applied to the abdomen and thighs. The middle and/or low frequency generator 140 is controlled by the controller 220 to modulate an amplitude of a current provided to the middle and/or low frequency generator 140 to burn the fat of the abdomen and thighs.

Figure 9:
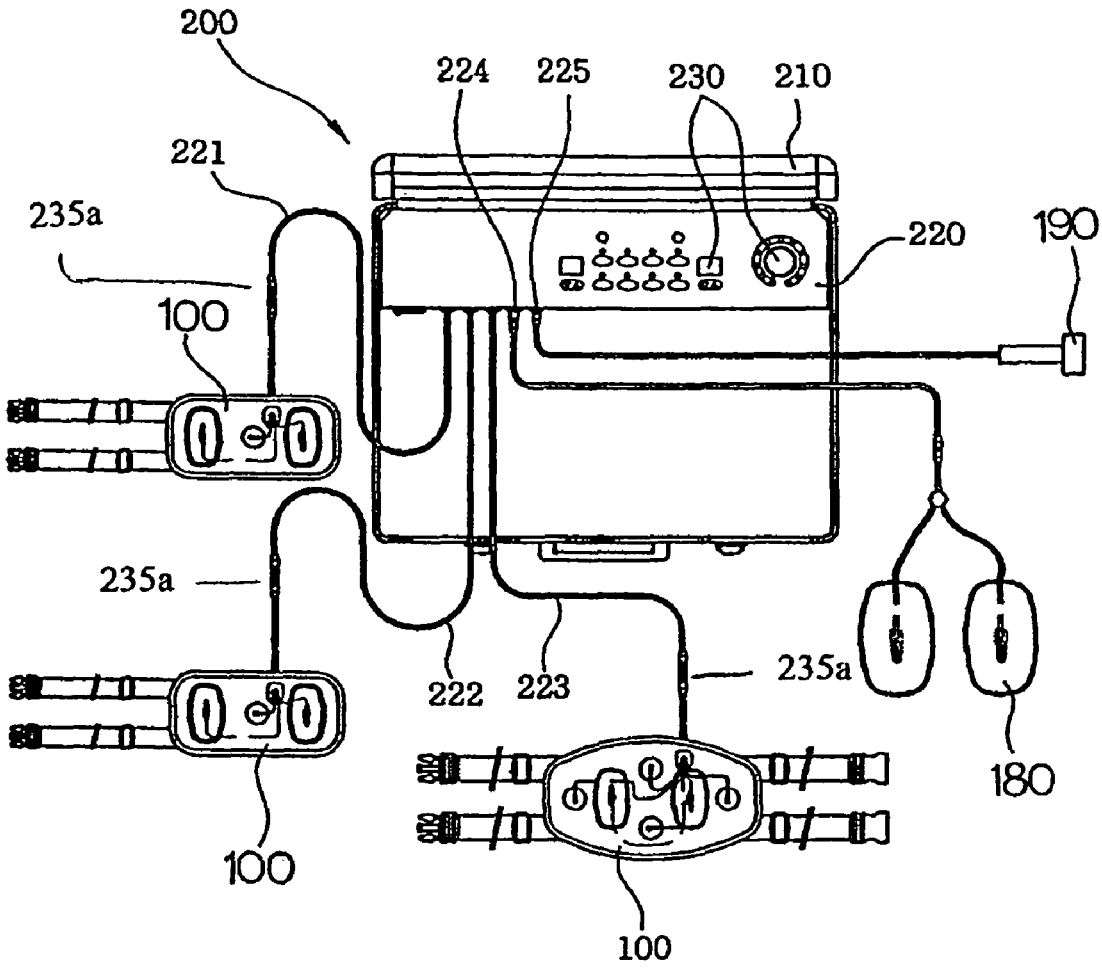
FIG. 9 is a top view illustrating the portable body illustrated in FIG. 8.

FIG. 9 is a top view illustrating the portable body illustrated in FIG. 8. Referring to FIGS. 8 and 9, the controller 220 has the connection lines 221, 222 and 223 on a front side thereof. Each of the connection lines 221, 222, and 223 has a predetermined length to electrically connect the body sculpture belt 100 to the power source. A pad connection unit 224 and a probe connection unit 225 are formed on the front of the controller 220, and are aligned along a direction that is the same as a direction in which the connection lines 221, 222 and 223 are orientated. The pad connection unit 224 and the probe connection unit 225 are electrically connected to the pad 180 and the probe 190, respectively.

The probe 190 massages the user's skin while it is rubbed on the skin, using an ultrasonic frequency generator installed to the inside thereof. The probe 190 may be shaped as "T-character type" or "knife type," etc. The probe 190 can massage the face, etc.

Referring to FIGS. 1 and 8, the display window 241, the connection lines 221, 222 and 223, the pad connection unit 224 and the probe connection unit 225, a detailed description for their electrical circuits will be omitted because they employ well-known circuits.

Figure 10:
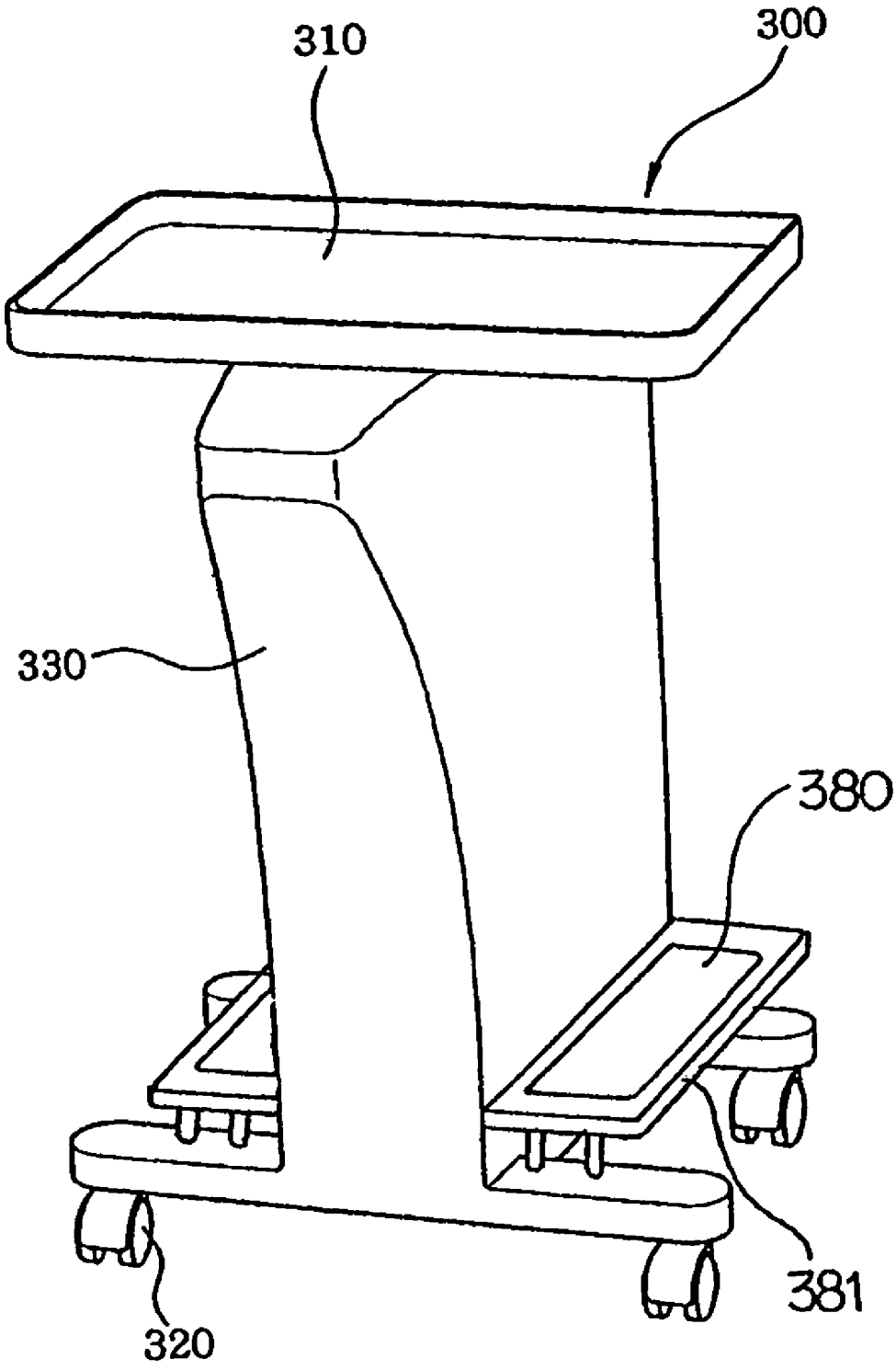
FIG. 10 is a perspective view illustrating a fixed body of the system of FIG. 1.

FIG. 10 is a perspective view illustrating the fixed body 300 of the system of FIG. 1. Referring to FIGS. 1 and 10, in order to use the portable body 200, the portal body 200 is stably fixed to the upper end of the fixed body 300, and then the cover 210 is opened. Afterward, a corresponding body sculpture belt 100 is electrically connected to the controller 220. The fixed body 300 may also be referred to as a pedestal.

The one or more body sculpture belts 100 are connected to the corresponding connection lines 221, 222, and 223. The pad 180 is connected to the pad connection unit 224. The probe 190 is connected to the probe connection unit 225. The body sculpture belts 100 are applied to the abdomen, thighs, and arms, etc. Each of the connection lines 221, 222, and 223 may connect to the connector 235 of the corresponding body sculpture belt 100 by the connector 235*a*. The connector 235*a* is provided at ends of the connection lines 221, 222, and 223. The connectors 235 and 235*a* may be detachably connected to each other.

The pad 180 may be a type of low frequency generator and can easily and closely to access a portion of the user's body that cannot be accessed by the body sculpture belt 100.

When power is applied to the portable body 200 according to the present general inventive concept, the operational states such as the temperature, the time, the strength, etc., are set through the control unit 230, and the present operation states are displayed through the display window 241.

Figure 11:
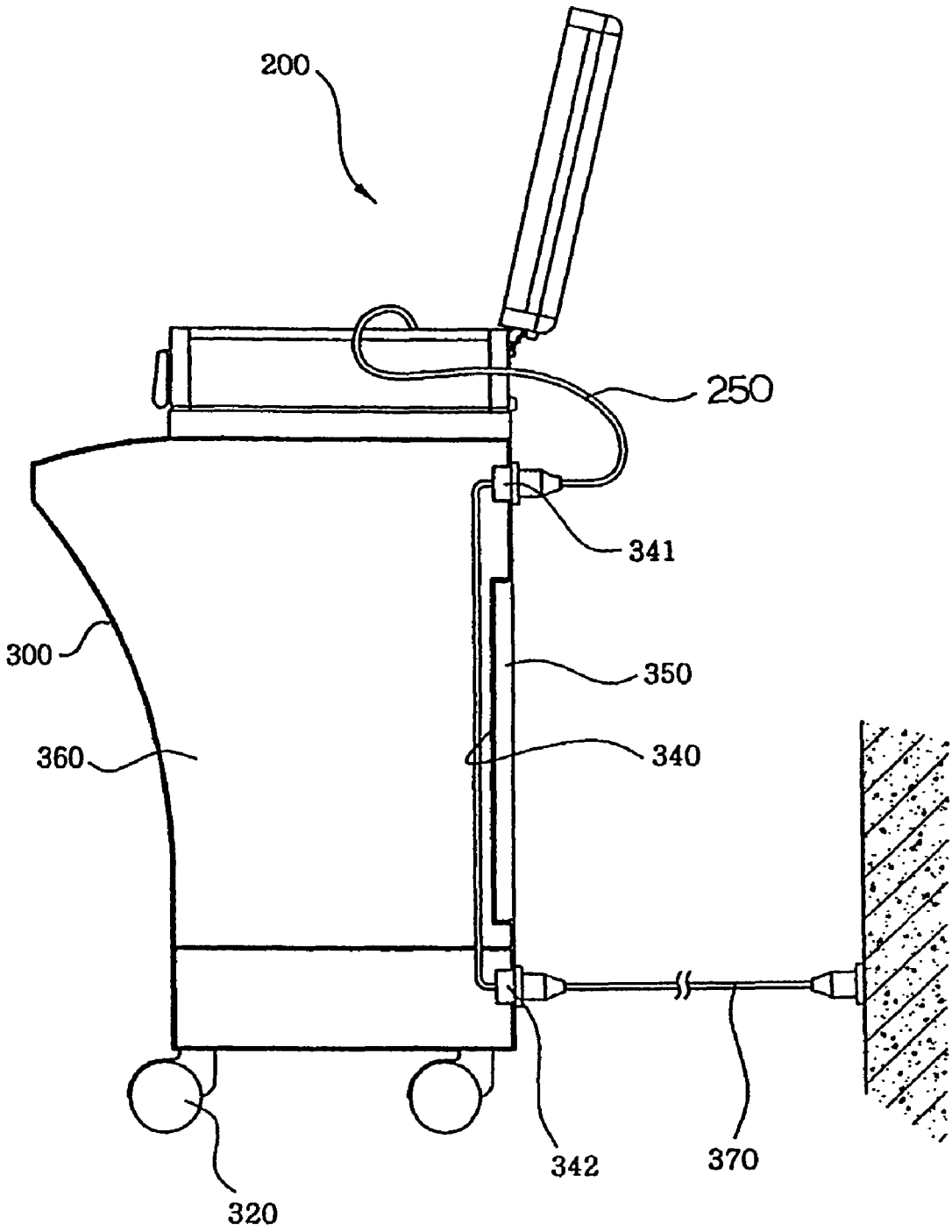
FIG. 11 is a cross-sectional side view illustrating a using state of the fixed body illustrated in FIG. 10.

FIG. 11 is a cross-sectional side view illustrating a using state of the fixed body illustrated in FIG. 10. Referring to FIGS. 10 and 11, the fixed body 300 includes a supporter 330, a holder 310, and a socket connection 340. The holder 310 is formed on an upper end of the supporter. The socket connection 340 is provided to wire a power source line 250 on a bottom of the supporter 330 to the top of the supporter 330. The socket connection 340 may be located on a rear side of the supporter 330. The socket connection 340 connects a lower socket connector 342 to an upper socket connector 341. A main power line 370 can be plugged into the lower socket connector 342 and the power source line 250 can be plugged into the upper socket connector 341.

The supporter 330 includes movement wheels 320 provided on the lower end thereof, to easily and simply perform movement of the fixed body 300. The supporter 300 includes a receiving unit 360 with a predetermined size at an inner and middle portion thereof to receive and store the body sculpture belts 100 and connection lines 221, 222, and 223 therein. The receiving unit 360 may be accessed by a door 350.

The receiving unit 360 and the door 350 may be formed at the rear side of the supporter 300. The height of the fixed body 330 may be positioned to a lower portion of the user's waist so that the user can easily and simply manipulate the portable body 200.

The holder 310 formed on the upper end of the supporter 330 to stably fix the portable body 200 thereon. The fixed body 300 supports the body sculpture belt 100 and the portable body 200 at a predetermined height so that the user can easily use the body sculpture belt 100 and the controller 220.

The socket connection 340 is connected at one end to the upper socket connector 341 connected to the power line 250 of the portable body 200, and connected at another end to the lower socket connector 342 connected to the main power line 370, in which the upper and lower socket connectors 341 and 342 are formed on the rear side of the fixed body 330.

The supporter 330 may include steps 380 on opposite sides of the lower part of the supporter 330. The steps 380 may include treatment pads 381 thereon to stimulate the soles of the feet when the feet are put on the treatment pads 381. Treatment elements used in the treatment pad 381 may include an ultrasonic frequency generator, a middle and/or low frequency generator, and a surface heating body, etc. The treatment pads 381 of the steps 380 may be used as the user sits and puts the user's feet on the steps 380, regardless of whether the user wears the body sculpture belt 100.

After the fixed body 300 is moved to a desired location using the movement wheels 320 attached to the supporter 330, the portable body 200 electrically connected to the body sculpture belt 100 and is stably fixed on the holder so that the user can easily operate the control unit 230.

Next, the power source line 250 of the portable body 200 is connected to the upper socket 341, and the main power line 370 is connected to the lower socket 342.

After using the body sculpture belt 100, pads 180, and wand 190 to massage and sculpt the body, the body sculpture belt 100, the pads 180, and the wand 190 can be kept in the inside of the control box 211 or in the receiving unit 360.

As described above, since the one or more ultrasonic frequency generators and the middle/low frequency generator are formed in the inside of the body sculpture belt, adipose tissue in the abdomen, waist, thighs, arms, etc., of the user's body can be effectively burned by vibration and currents of the one or more ultrasonic frequency generators and the middle and/or low frequency generator. Also, a blood circulation of the user's body can be enhanced by heat due to friction from the vibration.

As described above, since the vibrator head and the binding unit of the one or more ultrasonic frequency generators are fixed to an inside surface and an outside of the body, respectively, the one or more ultrasonic frequency generators are easily and simply assembled and dissembled when applying the after-sales service thereto.

As described above, since an ornamental plate is formed on a front of a cover of a portable body, in which a display apparatus implemented with a LED and an LCD formed at the center portion thereof, an appearance of the portable body can be beautiful, and a present state of the portable body can be determined by the naked eye.

As described above, since connection lines of the one or more ultrasonic frequency generators and the middle and/or low frequency generator are formed with a predetermined length, a plurality of body sculpture belts can be easily connected to the device through the connection lines. In addition, a pad and a probe to sculpt a body can be electrically connected to the device.

As described above, since the body sculpture belts and the portable body to control the body sculpture belts are stably fixed to a fixed body with a predetermined height, the user can easily and simply manipulate them.

As described above, since a power line of the fixed body is not directly connected to a socket on a wall, but connected to the socket on the wall through a connection socket formed on a rear side of the supporter, the power line cannot be easily interrupted by an external force. Therefore, the user can stably use the device. In addition, because the supporter has a receiving unit therein, attachments for a body sculpture belt can be simply stored therein.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A device to sculpt a body, comprising:

a body sculpture belt to vibrate a specific body part of the body, comprising;

at least one low and/or middle frequency generator to generate a first vibration with low and/or middle frequency;

at least one ultrasonic frequency generator to generate a second vibration with an ultrasonic frequency; and a power and/or signal cable to supply a power signal to the at least one middle and/or low frequency generator and the at least one ultrasonic frequency generator.

2. The body sculpting belt of claim 1, wherein the at least one ultrasonic frequency generator comprises:

a vibrator head provided on a first side of the body sculpture belt;

a vibrator to vibrate the vibrator head;

a binding unit provided on a second side of the body sculpture belt to bind the vibrator and vibrator head to the body sculpture belt.

3. The body sculpting belt of claim 2, the binding unit comprising:

coupling holes formed in the vibrator head;

coupling holes formed in the binding unit to correspond to the coupling holes of the vibrator head; and coupling members receivable in the coupling holes of the binding unit and vibrator head to fasten the binding unit to the vibrator head through the body sculpture belt.

4. The body sculpting belt of claim 1, wherein the power and/or signal cable has a connection unit.

5. The body sculpting belt of claim 1, wherein the at least one middle and/or low frequency generator is attached to the body sculpture belt by silicon.

6. The body sculpting belt of claim 1, wherein:

the at least one ultrasonic frequency generator is even in number, and the at least one middle and/or low frequency generator is odd in number.

7. The body sculpting belt of claim 1, further comprising:

a surface heat emitting body to provide heat to the body.

8. The body sculpting belt of claim 1, wherein the at least one ultrasonic frequency generator and the at least one middle and/or low frequency generator are provided on a same side of the body sculpture belt and are exposed to the body.

9. The body sculpting belt of claim 1, further comprising:

a vibrator to vibrate an eccentric cam.

10. A body sculpting belt to vibrate a portion of a user's body, the body sculpting belt comprising:

a body;

at least one low and/or middle frequency generator attached to the body to generate a first vibration with low and/or middle frequency;

at least one ultrasonic frequency generator attached to the body to generate a first vibration with an ultrasonic frequency.

11. The body sculpting belt of claim 10, wherein each respective ultrasonic frequency generator comprises:

a vibrator head provided on a first side the body;

a binding unit provided on a second side of the body to bind with the vibrator head and attach the respective ultrasonic frequency generator to the body.

12. The body sculpting belt of claim 11, wherein each respective ultrasonic frequency generator comprises:

at least one coupling member to bind the vibrator head to the binding unit through the body.

13. The body sculpting belt of claim 11, wherein each respective ultrasonic frequency generator comprises:

a vibrator provided on a first side of the body and attached to the vibrator head.

14. The body sculpting belt of claim 10, further comprising:

a cable attached to the body to receive a power signal to be supplied to each respective low and/or middle frequency generator and each respective ultrasonic frequency generator.

15. The body sculpting belt of claim 10, wherein each respective low and/or middle frequency generator is attached to the body by silicon.

16. The body sculpting belt of claim 10, wherein the body sculpting belt comprises a plurality of low and/or middle frequency generators and the at least one ultrasonic frequency generator is attached to the body between the plurality of low and/or middle frequency generators.

* * * * *